US005845868A

United States Patent [19]

Klerelid et al.

[11] Patent Number: 5,845,868

[45] Date of Patent: Dec. 8, 1998

[54] APPARATUS AND METHOD FOR WINDING PAPER

[75] Inventors: Bernt Erik Ingvar Klerelid; Tord Olof Sixten Svanqvist; Bo Lennart Herbert Örtemo, all of Karlstad, Sweden

[73] Assignee: Valmet-Karlstad AB, Karlstad, Sweden

[21] Appl. No.: 887,581

[22] Filed: Jul. 3, 1997

[51] Int. Cl.[6] ..... B65H 18/16

[52] U.S. Cl. ..... 242/541; 242/542.4; 492/5; 492/10

[58] Field of Search ..... 242/541.1, 541.4, 242/542.4; 492/4, 5, 9, 10

[56] References Cited

U.S. PATENT DOCUMENTS

| | | | |
|---|---|---|---|
| 3,224,698 | 12/1965 | Conti . | |
| 3,707,749 | 1/1973 | Henley . | |
| 4,143,828 | 3/1979 | Braun et al. . | |
| 4,193,559 | 3/1980 | Ballard . | |
| 4,283,023 | 8/1981 | Braun et al. . | |
| 4,509,237 | 4/1985 | Volz et al. | 492/10 |
| 4,792,076 | 12/1988 | Grunder . | |
| 5,106,029 | 4/1992 | Ehrola | 242/542.4 |
| 5,111,563 | 5/1992 | Brown et al. . | |
| 5,335,871 | 8/1994 | Fissmann et al. . | |
| 5,379,961 | 1/1995 | Urban et al. . | |
| 5,531,396 | 7/1996 | Kinnunen et al. . | |
| 5,566,451 | 10/1996 | Niskanen et al. | 492/5 |
| 5,591,309 | 1/1997 | Rugowski et al. . | |
| 5,607,551 | 3/1997 | Farrington, Jr. et al. . | |
| 5,673,870 | 10/1997 | Fielding et al. . | |

FOREIGN PATENT DOCUMENTS

| | | | |
|---|---|---|---|
| 0 157 062 B1 | 10/1985 | European Pat. Off. . | |
| 0 483 092 A1 | 4/1992 | European Pat. Off. . | |
| 0 483 093 B1 | 4/1992 | European Pat. Off. . | |
| 0 556 252 B1 | 8/1993 | European Pat. Off. . | |
| 0 638 500 A1 | 2/1995 | European Pat. Off. . | |
| 0 683 125 A2 | 11/1995 | European Pat. Off. . | |
| 97200848 | 3/1997 | European Pat. Off. . | |
| 42 08 790 | 9/1993 | Germany . | |
| 1-256451 | 10/1989 | Japan | 242/542.4 |
| WO 95/13980 | 5/1995 | WIPO . | |

OTHER PUBLICATIONS

Tord Svanqvist, *Reel Design for Soft Tissue,* 1991 Tissue Making Seminar, pp. 165–178 (Sep. 19–20).

Tuomisto, et al., Eliminating production losses on a paper machine reel, Tappi Journal, vol. 78, No. 10, pp.191–195.

Sales brochure, Valmet Paper Machinery, Inc., *The new Valmet Optireel increases your sales margin.*

Sales brochure, Valmet Paper Machinery, *Valmet Optireel™,* 1992.

Sales brochure, Valmet Paper Machinery, *Valmet Optireel™,* 1993.

*Primary Examiner*—John P. Darling

*Attorney, Agent, or Firm*—Bell Seltzer Intellectual Property Law Group of Alston & Bird, LLP

[57] ABSTRACT

An apparatus and method for winding tissue webs into a parent roll includes a rotatable reel drum having a flexible outer shell for engaging a web of tissue paper against a reel spool. A deflection sensor is mounted adjacent to the inner surface of the outer shell for measuring the amount of deflection of the flexible outer shell caused by the paper roll. The amount of deflection is related to the pressure at the nip point and, by moving the reel spool and flexible reel drum away from each other as the diameter of the paper roll increases, the pressure can be controlled at a desired level. Accordingly, a predetermined light nip pressure can be applied to the roll as the tissue web is wound thereon and large parent rolls of high bulk tissue can be manufactured with desired properties when unwound.

23 Claims, 2 Drawing Sheets

FIG. 2.
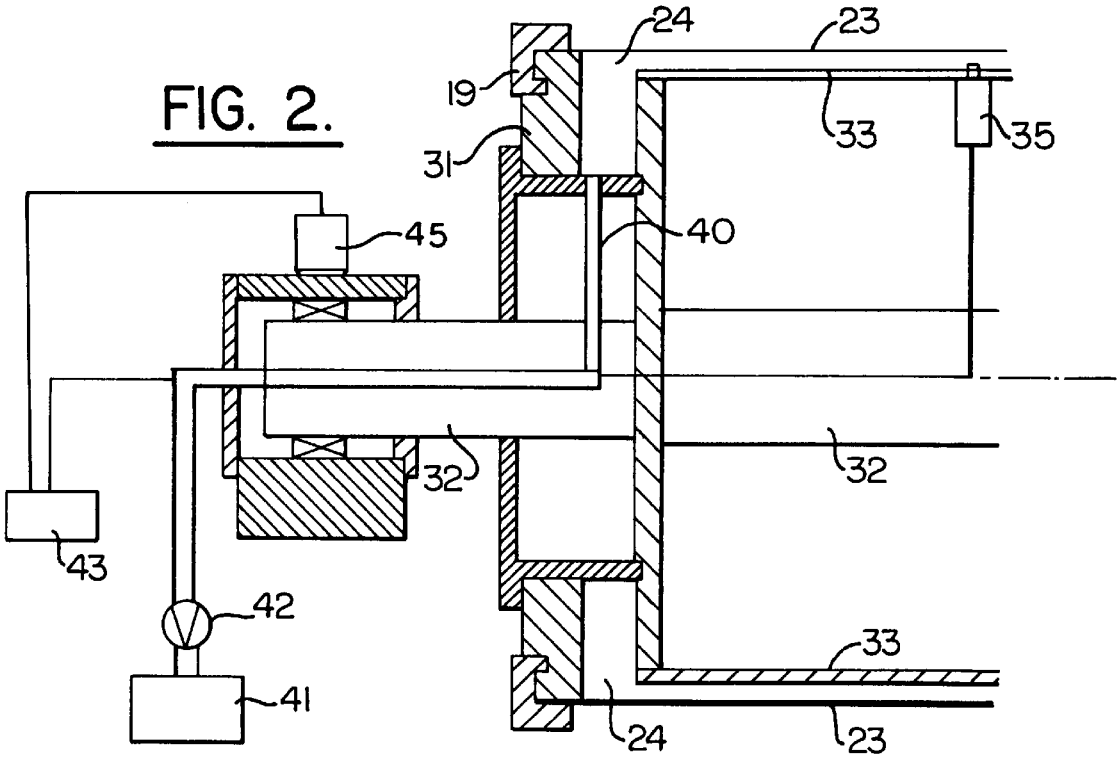
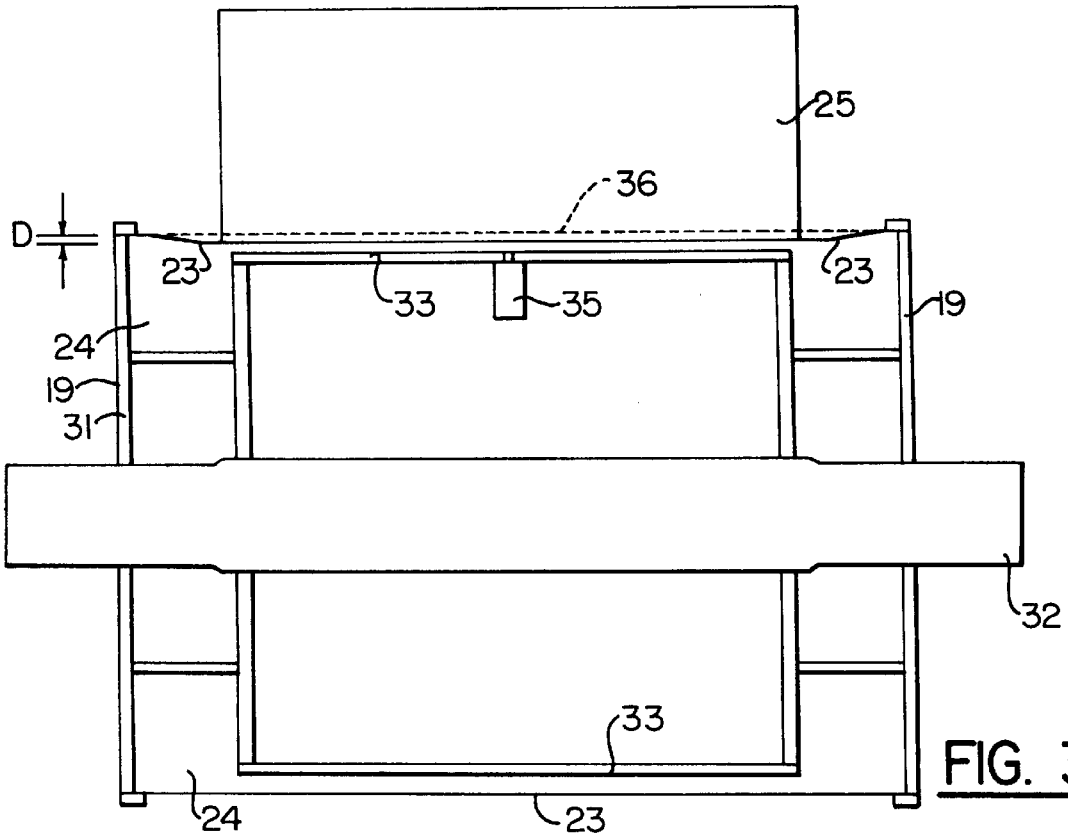
FIG. 3.

APPARATUS AND METHOD FOR WINDING PAPER

FIELD OF THE INVENTION

The present invention relates to papermaking, and more particularly relates to apparatus and methods for winding tissue manufactured on a papermaking machine.

BACKGROUND OF THE INVENTION

In the manufacture of various types of tissue products such as facial tissue, bath tissue, paper towels and the like, the dried tissue web or sheet coming off of the tissue machine is initially wound into a parent roll and temporarily stored for further processing. Sometime thereafter, the parent roll is unwound and the sheet is converted into a final product form.

In winding the tissue web into a large parent roll, it is vital that the roll be wound in a manner which prevents major defects in the roll and which permits efficient conversion of the roll into the final product, whether it be boxes of facial tissue sheets, rolls of bath tissue, rolls of embossed paper towels, and the like. Ideally, the parent roll has an essentially cylindrical form, with a smooth cylindrical major surface and two smooth, flat, and parallel end surfaces. The cylindrical major surface and the end surfaces should be free of ripples, bumps, waviness, eccentricity, wrinkles, etc., or, in other words, the roll should be "dimensionally correct." Likewise, the form of the roll must be stable, so that it does not depart from its cylindrical shape during storage or routine handling, or, in other words, the roll should be "dimensionally stable." Defects can force entire rolls to be scrapped if they are rendered unsuitable for high speed conversion.

Many defects can be introduced by improper winding, especially when winding high bulk, easily-compressible, soft tissue webs. A large number of such defects are discussed and shown in photographs in an article by W. J. Gilmore, "Report on Roll Defect Terminology—TAPPI CA1228," Proc. 1973 Finishing Conference, Tappi, Atlanta, Ga., 1973, pp. 5–19. Inadequate web stress near the core of the roll may cause the outer regions of the roll to compress the roll inwardly, leading to buckling in a starred pattern, commonly called "starring", as described by James K. Good, "The Science of Winding Rolls", *Products of Papermaking, Trans. of the Tenth Fundamental Research Symposium at Oxford*, September 1993, Ed. C. F. Baker, Vol. 2, Pira International, Leatherhead, England, 1993, pp. 855–881. Furthermore, starring causes the release of the tension of the web around the core that normally provides sufficient friction between the core and adjacent layers of the web. This loss of friction can result in core "slipping" or "telescoping", where most of the roll (except for a few layers around the core and a few layers around the outermost regions) moves en masse to one side with respect to the axis of the roll, rendering the roll unusable.

Current commercially available hard nip drum reels of the type with center-assisted drives, as described by T. Svanqvist, "*Designing a Reel for Soft Tissue*", 1991 Tissue Making Seminar, Karlstad, Sweden, have been successfully used to wind rolls of compressible tissue webs having bulks of up to about 8 to 10 cubic centimeters per gram, while avoiding the above-mentioned winding problems, by reducing the nip force and relying mainly on the in-going web tension control through modulation of the center-assisted drive for the coreshaft. However when using such methods to wind tissue sheets having bulk of 9 cubic centimeters per gram or higher and a high level of softness, as characterized, for example, by an MD Max Slope of about 10 kilograms or less per 3 inches of sample width, these problems will recur. These winding problems are accentuated when attempting to wind large rolls with diameters from about 70 inches to about 150 inches or greater, particularly at high speeds.

Without wishing to be bound by theory, it is believed that when a web is brought into a nip formed between the parent roll and a pressure roll, two major factors besides the in-going web tension affect the final stresses inside a wound roll. Firstly, the portion of the parent roll in the nip is deformed to a radius which is smaller than the undeformed radius of the parent roll. The expansion of the parent roll from its deformed radius to its undeformed radius stretches the web and results in a substantial internal tension increase from the set tension of the web going into the nip.

Another factor is sometimes called the "secondary winding" effect. A portion of the web is added to a roll after it passes first through the nip between the parent roll and the pressure roll. It then passes under the nip repeatedly at each rotation of the parent roll while more layers are added on the outer diameter. As each point near the surface of the roll reenters the nip, the web is compressed under the nip pressure, causing air in the void volume of the web to be expelled between the layers. This can reduce the friction between the layers sufficiently to allow the layers to slide tighter around the inner layers, as described by Erickkson et al., *Deformations in Paper Rolls*, pp. 55–61 and Lemke, et al., *Factors involved in Winding Large Diameter Newsprint Rolls on a Two-Drum Winder*, pp 79–87 Proc. of the *First International Conference on Winding Technology,* 1987.

The tension in each layer as it is added to the parent roll causes a compression force exerted by the outer layer to the layers underneath, thus the cumulative effect of compression from the outer layers will normally cause the web at the region around the core to have the highest interlayer pressure. The secondary winding further adds to this pressure. Soft tissue is known to yield when subjected to compression, thus absorbing some of the increases in pressure to the extent that it loses its ability to deform. Consequently, the cumulative pressure can rise at a steep rate to excessive levels that can cause a wide variation in the sheet properties unwound from the parent rolls.

Unfortunately, the internal pressure and web tension gradient that exists along the radius of a conventionally wound parent roll, while successful in preventing dimensional stability problems, can lead to undesired variability in the properties of the web. High tension in some regions causes some of the machine direction stretch to be pulled out during winding, and high internal pressure results in loss of bulk. Upon unwinding, regions that have been stretched more by high tension in and after the nip will have lower basis weight because of longitudinal stretching of the web. These changes in crucial web properties lead to variability in product quality and difficulties in converting operations.

Compensating for the internal pressure build-up, according to the above-mentioned method described by T. Svanqvist, can be carried only to a certain extent. As the density and strength of the web material is reduced much lower than the levels cited, uncertainties in the magnitude of frictional forces in the winding apparatus and other factors which change during the course of winding a roll make precise nip loading control very difficult. Alternatively, loss of control of the winding process can result in a reversal in tension gradient that can lead to the starring and core slippage problems described above.

Pure center winding without a nip is known for some delicate materials, but with tissue webs of the types discussed above high web tension would be needed to apply adequate pressure in the roll and machine direction stretch would be reduced. With pure center winding, tension near the core needs to be higher to prevent telescoping of the roll and other defects. Pure center winding also suffers from speed limitations. At higher speeds, web tension would be too high and sheet flutter would lead to breaks and poor reeling.

For many tissue sheets, the presence of the hard nip at the point of winding is not a problem because the sheet is relatively dense and can withstand the amount of compression it experiences without detriment to final product quality. However, for some recently developed tissue sheets, particularly soft, high bulk uncreped throughdried tissue sheets as disclosed in U.S. Pat. No. 5,607,551 to Farrington, Jr. et al., it has been found that traditional winding methods are unable to reliably produce a parent roll with appropriate web tension and radial pressure throughout to yield an unwound sheet of substantially uniformity.

Recent tissue machines have included a fabric belt or other flexible support member for supporting the tissue web and engaging the web against the reel spool. The fabric belt can eliminate any "open draw" between the dryer of the machine and the reel spool. An exemplary device having such a flexible member is the subject of copending U.S. patent application, Ser. No. 08/888,062, which is incorporated herein by reference. Therefore there is a need for a method of winding soft, bulky tissue sheets in which the variability in sheet bulk, caliper, machine direction stretch and/or basis weight is minimized, while still maintaining parent roll characteristics that are favorable to manufacturing and converting operations.

SUMMARY OF THE INVENTION

These and other needs are met by the apparatus and method according to the present invention which includes a rotatable reel drum having a flexible outer shell for engaging the web of tissue paper against a reel spool. The flexible outer shell thus forms a "soft nip" with the reel spool. A deflection sensor is mounted adjacent to the inner surface of the outer shell for measuring the amount of deflection of the flexible outer shell caused by the paper roll. The amount of deflection is related to the pressure at the nip point and, by moving the reel spool and flexible reel drum away from each other as the diameter of the paper roll increases, the pressure can be controlled at a desired level. Accordingly, the tissue winding parameters are greatly improved and the differences in properties of an unwound paper roll can be minimized.

More particularly, the apparatus includes a rotatably mounted reel spool and a drive motor for rotating the reel spool. A web of paper material is wound onto the reel spool while creating a roll of increasing diameter.

The rotatable reel drum includes an axle and a cylindrical outer shell supported on the axle for rotation, which thus defines a predetermined cylindrical path of travel. The outer shell is advantageously flexible and positioned adjacent to the reel spool to engage the web against the reel spool during winding. This engagement deflects the outer shell from the predetermined path of travel by an amount which is relative to the amount of paper material wound on the reel spool and the pressure applied to the reel spool by the reel drum.

A deflection sensor is mounted to the axle adjacent to the inner surface of the outer shell. The deflection sensor is arranged to measure the amount of deflection of the outer shell from the predetermined cylindrical path of travel. In a preferred embodiment, the deflection sensor includes a laser light source for directing laser light onto the inner surface of the outer shell and a receiver for receiving laser light reflected from the outer shell. Such a sensor can accurately determine the amount of deflection of the outer shell.

The apparatus also includes an actuator for positioning the reel spool and the reel drum relative to each other and a controller connected to the deflection sensor and the actuator. The controller and actuator can thus control the amount of deflection of the outer shell as the roll increases in diameter. The amount of deflection of the outer shell can be accurately maintained, and the pressure applied at the nip between the reel spool and reel drum can be maintained at a predetermined level which is much lower than has been previously attainable. As such, tissue parent rolls having improved uniformity of properties may be wound on the reel spool with the present apparatus.

In one preferred embodiment, the outer shell defines at least part of a sealed annular cavity around the axle and the apparatus further includes a source of compressed fluid in communication with the annular cavity. A controllable valve is provided between the source of compressed fluid and the annular cavity and is connected to the controller for controlling the pressure within the annular cavity.

The degree of deflection of the outer shell is an important variable which can advantageously be controlled to improve the uniformity of the sheet throughout the resulting parent roll. If the outer shell is deflected beyond a predetermined limit, the position of the reel spool relative to the outer shell is adjusted to either increase or decrease the distance between the reel spool and the outer shell.

By controlling this distance to a small value during the entire time the parent roll is building, the nip force between the parent roll and the surface of the outer shell is minimized to a level much lower than can be attained from the hard nip of a pressure roll. This in turn eliminates the effects of nip stretching and secondary winding while allowing the web tension dictated by the center drive system to be a bigger factor in controlling the interlayer tension in the roll. The uncertainties associated with measuring small nip forces and changing bearing friction during the building of the roll are completely obviated.

In addition, however, the apparatus can be operated in both a deflection control mode, wherein the deflection of the outer shell is used to control the position of the reel spool relative to the reel drum as discussed above, and in a load control mode, wherein a load sensor associated with the actuator senses the load exerted on the paper roll. In the load control mode, the controller uses the sensed load to control the position of the reel spool relative to the reel drum.

The reel drum may further include a substantially rigid inner shell mounted to the axle concentrically within the outer shell. Accordingly, in the load control mode, the annular cavity is deflated so that the paper roll can be quickly engaged against by substantially rigid inner shell of the reel drum and a uniform load can be applied to the parent roll.

Parent rolls wound on a winder in accordance with this invention have an internal pressure distribution such that the peak pressure at the core region reaches values lower than those attained from a conventional reel, yet which are sufficient to maintain the mechanical stability required for normal handling. The parent rolls from the method of this invention have an internal pressure near the core which decreases to a certain level and then displays a significant region with an essentially flat pressure profile, except for the inevitable drop to low pressure at the outer surface of the roll. Thus, the uniformity of sheet properties throughout the parent roll is substantially improved.

BRIEF DESCRIPTION OF THE DRAWINGS

FIG. 2 is a detailed cross section of one end of a rotatable reel drum according to the invention illustrating a laser deflection sensor adjacent to a flexible outer shell.

FIG. 3 is an enlarged schematic view of the rotatable reel drum illustrating the deflection caused in the outer shell by the parent roll.

DETAILED DESCRIPTION OF THE DRAWINGS

Figure 1:
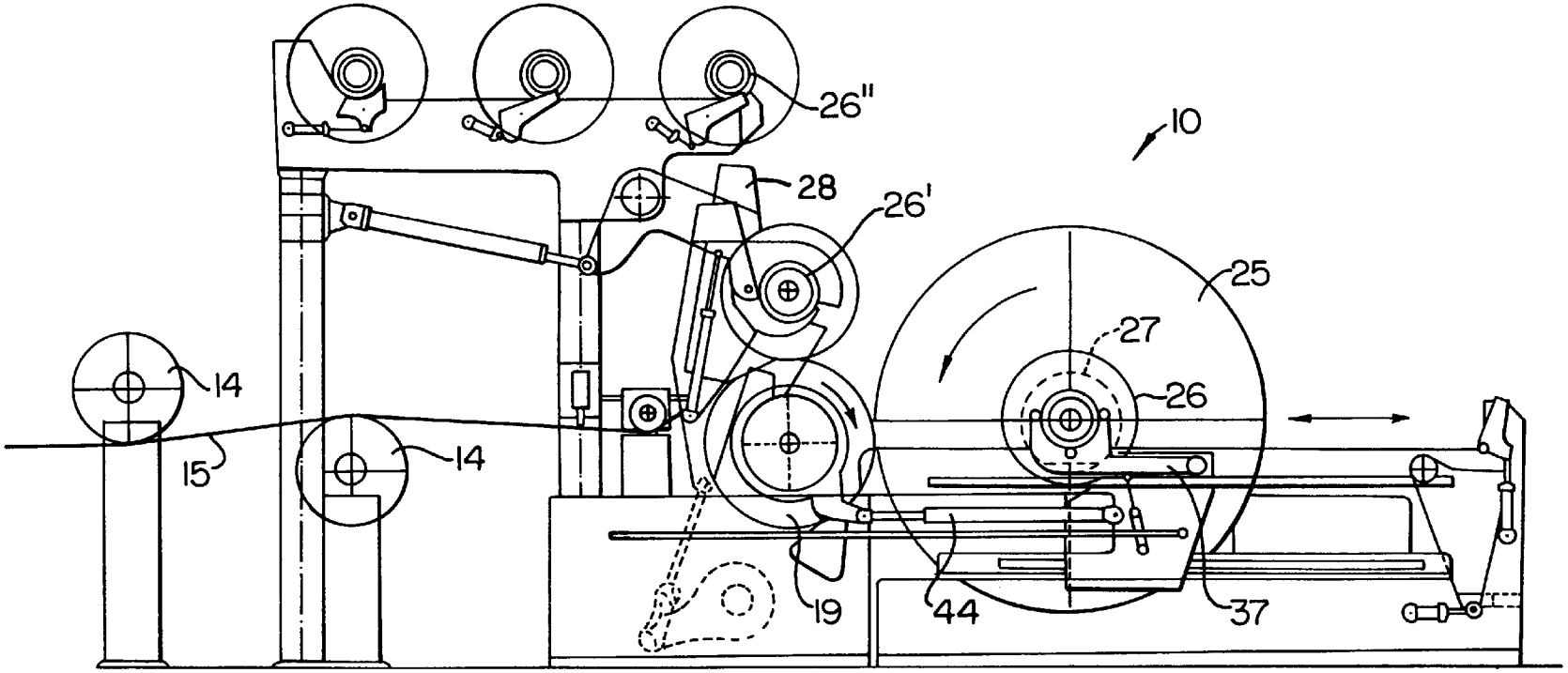
FIG. 1 is an elevation view of a winding apparatus according to the present invention.

A winding apparatus for a tissue papermaking machine 10 according to the present invention is illustrated in FIG. 1. A dried tissue sheet 15 is formed on a conventional tissue papermaking machine and advanced to the winding apparatus 10. It should be understood that the present invention could be used with either creped or uncreped papermaking machines. The sheet 15 is advanced through a pair of guide rolls 14 and over a reel drum 19 to a reel spool 26 which is driven by a center drive motor 27 acting on the shaft of the reel spool. The paper wound on the reel spool 26 forms a parent roll 25 which, when fully wound, is removed from the apparatus for further operations, such as converting.

Reference numbers 26, 26' and 26" illustrate three positions of the reel spools during the operation. As shown, a new reel spool 26' is ready to advance to the winding position as the parent roll 25 is building. When the parent roll 25 has reached its final predetermined diameter, the new reel spool 26' is lowered by a pair of arms 28 into position against the rotatable reel drum 19. The new reel spool 26' is lowered to a position where it is generally on the same horizontal level as the reel drum 19, as illustrated in FIG. 1, before winding begins. Alternatively, the new reel spool 26' may be slowly lowered to the horizontal level of the reel drum 19 as the roll of paper wound thereon grows in diameter for maintaining an even load in the cross machine direction, as disclosed in European Patent No. EPO 483 093 B1 published Jan. 3, 1996.

The reel spool 26 is supported by a pair of carriages 37, one of which is illustrated in FIG. 3. As the parent roll 25 builds, the reel spool 26 moves away from the reel drum 19. The reel spool 26 can be moved in either direction, however, as illustrated by the double-ended arrow.

The rotatable reel drum 19 is illustrated in more detail in FIGS. 2 and 3 and includes a flexible outer shell 23 mounted on an axle 32. The flexible outer shell 23 is preferably made of impervious material, such as any of various hard rubbers or plastics, and defines at least part of a sealed annular cavity 24. The annular cavity 24 is also bounded in part by end hubs 31 which secure the ends of the outer shell 23 to the axle 32. A substantially rigid inner shell 33 is mounted to the axle 32 and may also form a part of the sealed annular cavity 24. Alternatively, it would be appreciated that the inner shell 33 could be perforated in which case the sealed annular cavity 24 would extend from the outer shell 23 to the axle 32. In addition, although illustrated as having an axle of substantially continuous cross section, the reel drum 19 could include two stub axles at either end and the substantially rigid inner shell 33 (or other internal member) could support the load between the end hubs 31. The reel drum 19 can be driven by a drive motor independent of the reel spool center drive motor 27.

The sealed annular cavity 24 is advantageously pressurizable with a fluid medium, such as air. In particular, the axle 32 is preferably at least partially hollow and a connecting conduit 40 extends through the axle to the annular cavity 24. A source of compressed air 41 is connected to the connecting conduit 40 so that the annular cavity 24 can be pressurized and a predetermined amount of resiliency can be imparted to the outer shell 23. A controllable valve 42 regulates the air pressure within the reel drum 19 and can release all of the pressurized air in the cavity 24 if so desired. Alternatively, the reel drum 19 can include a resilient core in combination with, or as a substitute for, the pressurized annular cavity. For example, the reel drum 19 can include a foam rubber core having a wearable outer shell affixed to the periphery of the core. As a further alternative, the outer shell 23 can be formed of a sufficiently stiff or reinforced material such that no resilient member or pressurized cavity behind the outer shell 23 is necessary.

In operation, the parent roll 25 causes a deflection in the outer shell 23 as the diameter of the parent roll increases. The outer shell 23 is deflected from a predetermined cylindrical path of travel denoted by numeral 36 in FIG. 3. The amount of deflection D is measured by a non-contacting sensing device 35 which is focused on the inside of the outer shell 23. One object of the invention is to minimize and control the pressure exerted by the parent roll 25 against the sheet supported by the reel drum 19 as well as minimize the nip length created by the contact. The sensing device 35, such as a laser displacement sensor discussed below, detects changes in transfer belt deflection of as small as 0.005 inches. A predetermined baseline value from which the absolute amount of deflection D can be ascertained is the undeflected path of travel 36 of the outer shell 23.

A particularly suitable laser sensing device 35 is laser displacement sensor Model LAS-8010, manufactured by Nippon Automation Company, Ltd. and distributed by Adsens Tech Inc. The Nippon Automation LAS 8010 sensor has a focused range of 140 to 60 mm and is connected to a programmable logic controller 43. The front plate of the sensor can be mounted 120 mm. from the inside surface of the outer shell 23. Such a sensor is designed to give a 4 to 20 mA output in relation to the minimum to maximum distance between the sensor and the outer shell 23. The winder is first operated without a roll 25 loaded against the outer shell 23 to set the zero point in the programmable logic controller 43 based on the undeflected cylindrical path of travel 36 of the outer shell.

Although a preferred laser sensor is discussed above, several other suitable non-contacting and contacting sensing devices are well known in the art. Several are described by F. T. Farago and M. A. Curtis in *Handbook of Dimensional Measurements,* 3rd Ed., Industrial Press, Inc., New York, 1994. Such methods include laser-based distance or depth sensing devices using techniques such as laser triangulation; laser white light or multiple wavelength moiré interferometry, as illustrated by Kevin Harding, "Moire Inteferometry for Industrial Inspection," *Lasers and Applications*, November 1993, pp. 73–78, and Albert J. Boehnlein, "Field Shift Moire System," U.S. Pat. No. 5,069, 548, December 3, 1991; ultrasonic sensing, including methods described in L. C. Lynnworth, *Ultrasonic Measurements for Process Control*, Academic Press, Boston, 1989, and particularly the method of measuring the delay time for an ultrasonic signal reflected off a solid surface; microwave and radar wave reflectance methods; capacitance methods for determination of distance; eddy current transducer methods; single-camera stereoscopic imaging for depth sensing, as illustrated by T. Lippert, "Radial parallax binocular 3D imaging" in Display System Optics II, Proc. SPIE Vol. 1117, pp. 52–55 (1989); multiple-camera stereoscopic imaging for depth sensing, as illustrated by N. Alvertos, "Integration of Stereo Camera Geometries" in Optics, Illumination and Image Sensing for Machine Vision IV., Proc. SPIE, Vol. 1194, pp. 276–286 (1989); contacting probes such as rollers, wheels, metal strips, and other devices whose position or deflection is measured directly; and the like.

The laser sensor 35 is mounted to the inner shell 33 and thus rotates with the outer shell 23. The sensor 35 takes a measurement of the distance between the sensor and the outer shell 23 either continually or only at the moment when the sensor is directly opposite the point of greatest deflection, the latter of which may employ a rotary synchronizer. A rotary electrical coupling may be used to transmit the deflection data from the rotating sensor 35 to the fixed controller 43 outside of the reel drum 9. An RF transmitter could also be used to transmit the data from within the rotating drum 19.

Alternatively, it is within the scope of the invention that the sensor 35 is fixed from rotating relative to the parent roll 25 by way of a hollow shaft or other device which is stationary within the outer shell 23. For example, the inner shell 33 could be supported on a fixed inner shaft extending through a hollow axle for the outer shell 23.

Once the outer shell 23 deflection D has been measured, a proportional only control loop associated with the programmable logic controller preferably maintains that deflection at a constant level. In particular, the output of this control is the setpoint for a hydraulic servo positioning control system 44 for the carriages 37 which hold the reel spool 26 and building parent roll. Other mechanical and electrical actuators for positioning the reel spool 26 in response to the sensor input which may suitable for achieving this objective can be designed and constructed by those skilled in the art of building high speed winders. When the outer shell deflection D exceeds the setpoint, the carriage position setpoint is increased, moving the carriages 37 away from the outer shell 23 to return the deflection back to the setpoint.

The deflection control may use two laser distance sensors 35 each adjacent a respective edge of the outer shell 23 so as to be spaced from each other in the cross machine direction. As such, undesirable tapering of the roll 25 can be minimized or a positive taper can even be introduced intentionally to improve the winding parameters of the particular roll being wound.

A specific hydraulic servo positioning system consists of Moog servo valves controlled by an Allen-Bradley QB module with Temposonic transducers mounted on the rods of the hydraulic cylinders to determine position. The output from the deflection control loop is an input to two individual servo positioning systems on either side of the reel. Each system can then control, keeping the two sides of the reel parallel if desired. A protection system that stops the operation if the parallelism exceeds a certain threshold level may be desirable, but it is not necessary to have an active system to keep the two sides parallel.

It would be appreciated that the acceptable amount of deflection D for any given tissue sheet is in part determined by the design of the outer shell 23 and the pressure imparted to the annular cavity 24 during operation. As the pressure is reduced, the acceptable amount of deflection will increase because the compression of the sheet is reduced. In addition, it may not always be optimal to maintain the amount of outer shell deflection D at a substantially constant level and it is within the scope of the invention that the amount of deflection may be controllably varied as the roll 25 increases in diameter.

The sensed deflection D of the outer shell 23 in combination with the sensed position of the reel spool carriages 37 may also be used to calculate the diameter of the building parent roll 25. The value calculated for the diameter of the roll can be useful in varying other operating parameters of the winding process including the rotational velocity at which the reel drum is rotated by the drive motor 27 as the diameter of the parent roll increases. This is useful so that a desired positive draw (the percentage difference by which the speed of the surface of the parent roll exceeds the speed of the surface of the reel drum, both of which are independently driven) can be maintained. The positive draw imparts a desired web tension as the web is wound on the roll and the drive motors are adjusted so that the draw is generally less than around 10%.

The apparatus of the invention can advantageously be operated in two modes; a deflection control mode and a load control mode. When in the deflection control mode, the deflection D of the outer shell 23 is used as an input to the controller 43 to control the position of the actuators and the reel spool 26 relative to reel drum 19. When in the load control mode, the load sensors 45 on the rods of the hydraulic cylinders of the actuators sense the load exerted on the parent roll 25 by the reel drum 19 and the controller uses the load data as input to determine the proper position of the actuators. The ability of the winding apparatus to switch between deflection control and load control modes is highly beneficial because it allows for flexibility in the operation of the papermaking machine. For example, the papermaking machine may be used to make both high bulk and low bulk tissue. With low bulk tissue, it may be preferable to operate in the load control mode so that an adequate nip load can be applied to ensure proper winding.

Many modifications and other embodiments of the invention will come to mind to one skilled in the art to which this invention pertains having the benefit of the teachings presented in the foregoing descriptions and the associated drawings. For example, the apparatus and method according to the present invention are not limited to use with only tissue, but may also be highly advantageous in winding all types of web materials, including other forms of paper such as paperboard. Therefore, it is to be understood that the invention is not to be limited to the specific embodiments disclosed and that modifications and other embodiments are intended to be included within the scope of the appended claims. In addition, although specific terms are employed herein, they are used in a generic and descriptive sense only and not for purposes of limitation.

That which is claimed:

1. An apparatus for winding a web of paper material into a roll, said apparatus comprising:

a rotatably mounted reel spool;

a drive motor for rotating said reel spool and winding a web of paper material thereon to create a roll of increasing diameter;

a rotatable reel drum comprising;

an axle;

a cylindrical outer shell supported on said axle for rotation and defining a predetermined cylindrical path of travel, said shell being flexible and positioned adjacent to said reel spool to engage the web against said reel spool during winding such that said outer shell is deflected from the predetermined cylindrical path of travel by an amount relative to the amount of paper material wound on said reel spool; and a deflection sensor mounted to said axle adjacent to the inner surface of said outer shell, said deflection sensor being arranged to measure the amount of deflection of said outer shell from said predetermined cylindrical path of travel;

an actuator for positioning said reel spool and said reel drum relative to each other to vary the amount of deflection of said outer shell; and a controller connected to said deflection sensor and said actuator for controlling the amount of deflection of said outer shell as the roll increases in diameter.

2. An apparatus as defined in claim 1 wherein said deflection sensor further comprises a laser light source for directing laser light onto the inner surface of said outer shell and a receiver for receiving laser light reflected from said outer shell.

3. An apparatus as defined in claim 1 wherein said outer shell defines at least part of a sealed annular cavity around said axle and wherein said apparatus further comprises:

a source of compressed fluid in communication with said annular cavity; and a controllable valve between said source and said annular cavity, said valve being connected to said controller for controlling the pressure within said annular cavity.

4. An apparatus as defined in claim 3 wherein said reel drum further comprises a substantially rigid inner shell mounted to said axle concentrically within said outer shell.

5. An apparatus as defined in claim 1 wherein said reel spool is rotatably mounted at either end on a translatable carriage and said actuator further comprises a hydraulic cylinder connected to each of said carriages.

6. An apparatus for winding a web of paper material into a roll, said apparatus comprising:

a rotatably mounted reel spool;

a drive motor for rotating said reel spool and winding a web of paper material thereon to create a roll of increasing diameter;

a rotatable reel drum comprising;

an axle;

a cylindrical outer shell supported on said axle for rotation and defining a predetermined cylindrical path of travel, said shell being flexible and positioned adjacent to said reel spool to engage the web against said reel spool during winding such that said outer shell is deflected from the predetermined cylindrical path of travel by an amount relative to the amount of paper material wound on said reel spool; and a deflection sensor mounted to said axle adjacent to the inner surface said outer shell, said deflection sensor being arranged to measure the amount of deflection of said outer shell from said predetermined cylindrical path of travel;

an actuator for positioning said reel spool relative to said reel drum;

a load sensor associated with said actuator for sensing the load exerted on the paper roll by the outer shell; and a controller connected to said deflection sensor, load sensor and actuator and being selectively operable in a deflection control mode wherein the amount of deflection of said outer shell is used to control the position of the reel spool relative to the reel drum and a load control mode wherein the amount of load exerted on the paper roll is used to control the position of the reel spool relative to the reel drum.

7. An apparatus as defined in claim 6 wherein said deflection sensor further comprises a laser light source for directing laser light onto the inner surface of said outer shell and a receiver for receiving laser light reflected from said outer shell.

8. An apparatus as defined in claim 6 wherein said outer shell defines at least part of a sealed annular cavity around said axle and wherein said apparatus further comprises:

a source of compressed fluid in communication with said annular cavity; and a controllable valve between said source and said annular cavity, said valve being connected to said controller for controlling the pressure within said annular cavity.

9. An apparatus as defined in claim 8 wherein said reel drum further comprises a substantially rigid inner shell mounted to said axle concentrically within said outer shell.

10. An apparatus as defined in claim 9 wherein said annular cavity is deflated in said load control mode so that the paper roll is engaged against the substantially rigid inner shell of said reel drum.

11. A reel drum for winding a web of paper material onto a reel spool, said reel drum comprising:

an axle;

a cylindrical outer shell supported on said axle for rotation and defining a predetermined cylindrical path of travel, said shell being flexible and positioned adjacent to the reel spool to engage the web against the reel spool during winding such that said outer shell is deflected from the predetermined cylindrical path of travel by an amount relative to the amount of paper material wound on said reel spool; and a deflection sensor mounted to said axle adjacent to the inner surface of said outer shell, said deflection sensor being arranged to measure the amount of deflection of said outer shell from said predetermined cylindrical path of travel.

12. A reel drum as defined in claim 11 wherein said deflection sensor further comprises a laser light source for directing laser light onto the inner surface of said outer shell and a receiver for receiving laser light reflected from said outer shell.

13. A reel drum as defined in claim 11 wherein said outer shell defines at least part of a sealed annular cavity around said axle which can be pressurized with a fluid medium.

14. A reel drum as defined in claim 13 wherein said reel drum further comprises a substantially rigid inner shell mounted to said axle concentrically within said outer shell.

15. A reel drum as defined in claim 14 wherein said inner shell defines at least part of said annular cavity.

16. A reel drum as defined in claim 13 wherein said axle is at least partially hollow and in fluid communication with said annular cavity for allowing passage of a pressurized fluid medium through said axle and into the annular cavity.

17. A reel drum as defined in claim 11 further comprising an end hub positioned adjacent each end of said reel drum and mounted to said axle, said outer shell being secured at either end to said end hubs.

18. A method of winding a web of paper material to form a roll, said method comprising the steps of:

engaging a rotatable reel drum against a reel spool, said reel drum having a flexible outer shell such that said outer shell is deflected from a predetermined cylindrical path of travel;

rotating the reel spool;

rotating the reel drum with the reel spool to create a nip;

advancing the web of paper material into the nip and directing the web around the reel spool to form a roll of increasing diameter;

sensing the amount of deflection of the outer shell by the roll as the diameter of the roll increases; and positioning the reel spool and the reel drum relative to each other in response to said sensing step to vary the amount of deflection of the outer shell of the reel drum.

19. A method of winding as defined in claim 18 wherein said sensing step further comprises the steps of:

directing laser light onto a surface of the outer shell opposite the roll;

receiving a reflection of the laser light from the surface of the outer shell; and calculating the deflection of the outer shell relative to a baseline value.

20. A method of winding as defined in claim 19 wherein said moving step further comprises moving the reel spool away from the reel drum as the diameter of the roll increases.

21. A method of winding a web of paper material to form a roll, said method comprising the steps of:

engaging a rotatable reel drum against a reel spool, said reel spool having a flexible outer shell such that said outer shell is deflected from a predetermined cylindrical path of travel;

rotating the reel spool;

rotating the reel drum with the reel spool to create a nip;

advancing the web of paper material into the nip and directing the web around the reel spool to form a roll of increasing diameter;

operating the reel drum in a deflection control mode including the steps of;

sensing the amount of deflection of the outer shell by the paper roll; and positioning the reel spool and the reel drum relative to each other in response to said deflection sensing step to vary the amount of deflection of the outer shell of the reel drum, and operating the reel drum in a load control mode including the steps of;

sensing the amount of load exerted on the paper roll by the reel drum; and positioning the reel spool and the reel drum relative to each other in response to said load sensing step to vary the amount of load exerted on the paper roll by the reel drum.

22. A method as defined in claim 21 further comprising the steps of:

pressurizing an annular cavity defined at least in part by the flexible outer shell of the reel drum during said deflection control operating step; and depressurizing the annular cavity during said load control operating step.

23. A method as defined in claim 22 wherein said depressurizing step comprises releasing pressure from the annular cavity to the extent the paper roll is engaged against a substantially rigid inner shell within the outer flexible shell.

* * * * *